US008678542B2

(12) United States Patent
Muyskens

(10) Patent No.: US 8,678,542 B2
(45) Date of Patent: Mar. 25, 2014

(54) SYSTEMS AND METHODS FOR COMMUNICATION OF DATE INFORMATION BETWEEN AN INK TANK AND A PRINTING DEVICE

(71) Applicant: Funai Electric Co., Ltd, Osaka (JP)

(72) Inventor: Robert Henry Muyskens, Lexington, KY (US)

(73) Assignee: Funai Electric Co., Ltd., Osaka (JP)

( * ) Notice: Subject to any disclaimer, the term of this patent is extended or adjusted under 35 U.S.C. 154(b) by 0 days.

(21) Appl. No.: 14/031,625

(22) Filed: Sep. 19, 2013

(65) Prior Publication Data

US 2014/0015877 A1 Jan. 16, 2014

Related U.S. Application Data

(62) Division of application No. 13/270,356, filed on Oct. 11, 2011, now Pat. No. 8,562,100, which is a division of application No. 11/956,686, filed on Dec. 14, 2007, now abandoned.

(51) Int. Cl.
*B41J 29/393* (2006.01)

(52) U.S. Cl.
USPC ..... 347/19

(58) Field of Classification Search
USPC ..... 347/6, 7, 19, 23
See application file for complete search history.

(56) References Cited

U.S. PATENT DOCUMENTS

| | | | | |
|---|---|---|---|---|
| 6,871,926 | B2 * | 3/2005 | Adkins et al. | 347/7 |
| 7,013,804 | B2 * | 3/2006 | Chelvayohan | 101/355 |
| 7,766,438 | B2 * | 8/2010 | Ehlert | 347/7 |

* cited by examiner

*Primary Examiner* — Anh T. N. Vo
(74) *Attorney, Agent, or Firm* — Amster, Rothstein, Ebenstein LLP

(57) ABSTRACT

Some or all of the needs above can be addressed by embodiments of the invention. According to one embodiment of the invention, a method for determining ink evaporation from at least one ink tank can be provided. The method can include determining a removal time associated with removal of at least one ink tank from a printing device. The method can also include determining an insertion time associated with insertion of the at least one ink tank into a printing device. In addition, the method can include estimating an amount of ink evaporation from the at least one ink tank during the time between the removal time and insertion time based at least in part on the difference between the removal time and insertion time.

4 Claims, 6 Drawing Sheets

SYSTEMS AND METHODS FOR COMMUNICATION OF DATE INFORMATION BETWEEN AN INK TANK AND A PRINTING DEVICE

This application claims priority and benefit as a divisional application of U.S. patent application Ser. No. 13/270,356, filed Oct. 11, 2011, entitled "Systems and Methods for Communication of Date Information Between an Ink Tank and a Printing Device," which in turn is a divisional of U.S. patent application Ser. No. 11/956,686, filed Dec. 14, 2007 (now abandoned), the contents of which are incorporated herein by reference in their entirety.

FIELD OF THE INVENTION

The invention relates generally to ink printers, and more particularly, to systems and methods for communication of date information between an ink tank and a printing device.

BACKGROUND OF THE INVENTION

Computer printers are well known in the prior art and include dot-matrix printers, piezo-electric ink jet printers, laser printers, thermal ink jet printers and other ink jet printing devices. When using an ink jet printing device, an ink jet cartridge or ink tank can be installed or otherwise mounted to the ink jet printing device to provide a supply of ink. In some instances, an ink jet cartridge or ink jet tank may be removed from the ink jet printing device. If removed from the printing device for an extended period of time, some or all of the supply of ink within the ink jet cartridge or ink jet tank may evaporate. Sometimes, a substantial amount of the supply of ink can evaporate within a relatively short time. If an empty or nearly empty ink jet cartridge or ink jet tank is re-installed within an ink jet printing device or other printing device, damage to the ink jet printing device or other printing device may result.

In some ink jet cartridge or ink tank designs, ink supply management may be an issue when a print head associated with the ink jet printing device or other printing device is starved of ink and air inside the print head may result in damage to the print head. In such designs, an optical sensing system can be used to detect free ink inside an ink jet cartridge or ink tank. However, evolving ink jet cartridge and ink tank designs may use foam or another medium to retain ink within the ink jet cartridge or ink tank, such that optical sensing may not be possible or accurate. To account for these evolving ink jet cartridge and ink tank designs, an amount of ink remaining inside the ink jet cartridge or ink tank can be determined by way of counting ink dots.

Therefore, a need exists for systems and methods for communication of date information between an ink tank and a printing device.

A further need exists for systems and methods for determining ink evaporation from at least one ink tank.

An additional need exists for systems and methods for determining remaining ink in a plurality of ink tanks associated with a printing device.

SUMMARY OF THE INVENTION

Some or all of the needs above can be addressed by embodiments of the invention. According to one embodiment of the invention, a method for determining ink evaporation from at least one ink tank can be provided. The method can include determining a removal time associated with removal of at least one ink tank from a printing device. The method can also include determining an insertion time associated with insertion of the at least one ink tank into a printing device. In addition, the method can include estimating an amount of ink evaporation from the at least one ink tank during the time between the removal time and insertion time based at least in part on the difference between the removal time and insertion time.

In another embodiment, a method for determining remaining ink in a plurality of ink tanks associated with a printing device can be provided. The method can include detecting opening of a printing device associated with a plurality of ink tanks The method can also include associating a first time with at least a portion of the ink tanks, wherein the first time is associated with the opening of the printing device. Furthermore, the method can include detecting closing of the printing device. In addition, the method can include determining a second time, wherein the second time is associated with the closing of the printing device. The method can also include determining whether at least one ink tank has been removed from the printing device. Further, the method can include estimating an amount of ink evaporation from at least one ink tank removed from the printing device between the first time and second time based at least in part on the difference between the first time and second time. The method can also include determining an amount of ink remaining in the at least one ink tank based at least in part on the amount of ink evaporation.

In yet another embodiment, a printing device can be provided. The printing device can include an ink evaporation estimation module operable to determine a removal time associated with removal of at least one ink tank from a printing device. The ink estimation module can also be operable to determine an insertion time associated with insertion of the at least one ink tank into a printing device. Further, the ink estimation module can be operable to estimate an amount of ink evaporation from the at least one ink tank during the time between the removal time and insertion time based at least in part on the difference between the removal time and insertion time.

In yet a further embodiment, a printing device with an ink evaporation estimation module can be provided. The ink estimation module can be operable to detect opening of a printing device associated with a plurality of ink tanks The module can be further operable to associate a first time with at least a portion of the ink tanks, wherein the first time is associated with the opening of the printing device. In addition, the module can be operable to detect closing of the printing device. Further, the module can be operable to determine a second time, wherein the second time is associated with the closing of the printing device. Furthermore, the module can be operable to determine whether at least one ink tank has been removed from the printing device. Moreover, the module can be operable to estimate an amount of ink evaporation from at least one ink tank removed from the printing device between the first time and second time based at least in part on the difference between the first time and second time. The module can also be operable to determine an amount of ink remaining or a number of ink dot counts remaining in the at least one ink tank based at least in part on the amount of ink evaporation.

In another embodiment, an apparatus for determining ink evaporation from an ink tank for a printing device can be provided. The apparatus can include an ink tank operable to mount to a print head. In addition, the apparatus can include a memory associated with the ink tank, the memory operable to store date information received from a printing device, wherein the date information is associated with the removal of the ink tank from the printing device, and the date information can be obtained by the printing device for comparison to other date information.

In yet another embodiment, a method for determining ink evaporation from an ink tank for a printing device can be provided. The method can include storing date information associated with removal of the ink tank from one printing device. In addition, the method can include transmitting at least a portion of the date information to a printing device for comparison to other date information associated with insertion of the ink tank in the printing device, wherein an estimate of an amount of ink evaporation from the ink tank can be determined based at least in part on the comparison.

Other systems, processes, printing devices, and apparatus according to various embodiments of the invention will become apparent with respect to the remainder of this document.

BRIEF DESCRIPTION OF THE DRAWINGS

Figure 1:
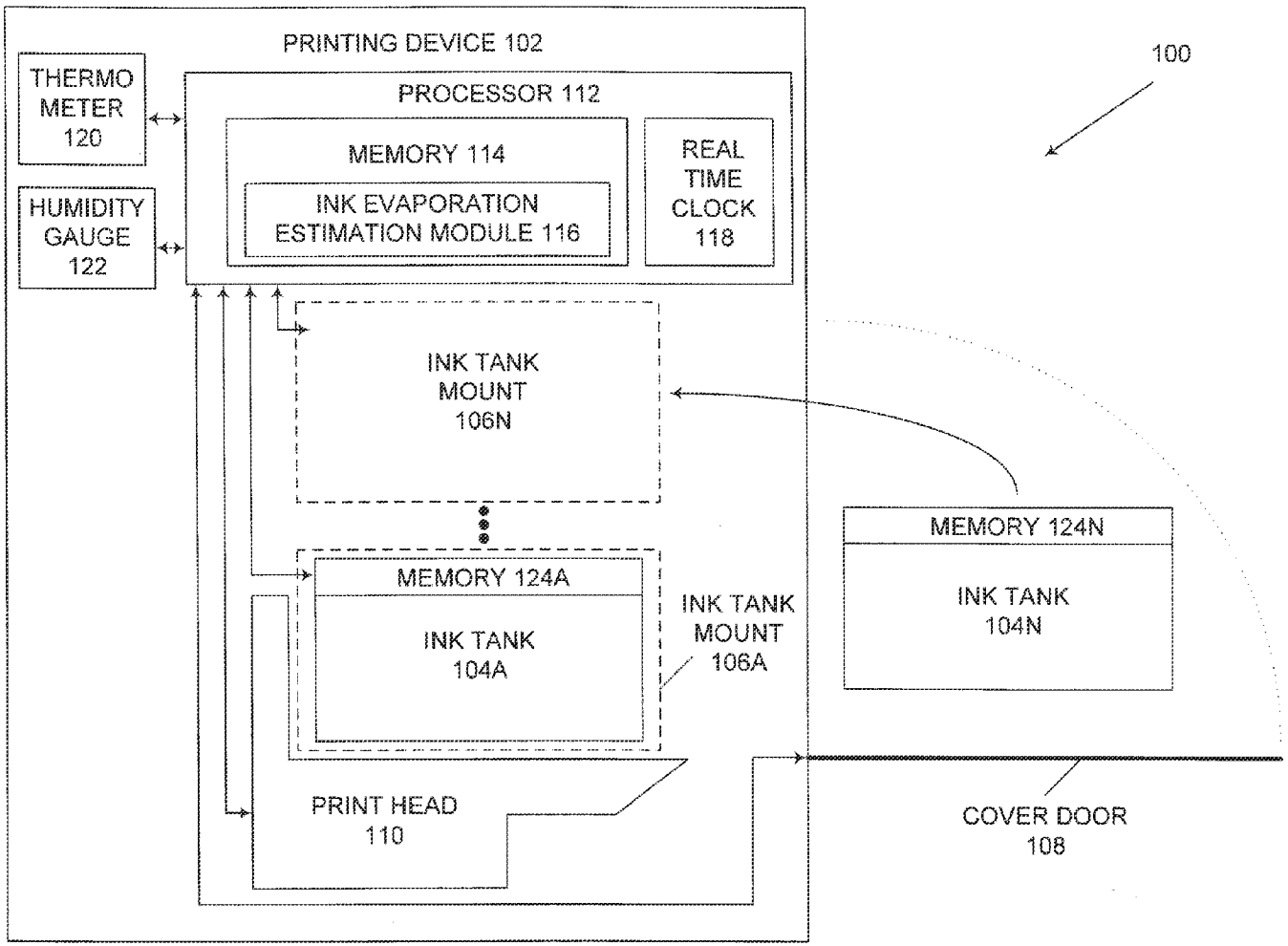

Having thus described the invention in general terms, reference will now be made to the accompanying drawings, which are not necessarily drawn to scale, and wherein:

FIG. 1 illustrates an example system, printing device, and apparatus in accordance with an embodiment of the invention.

Figure 2:
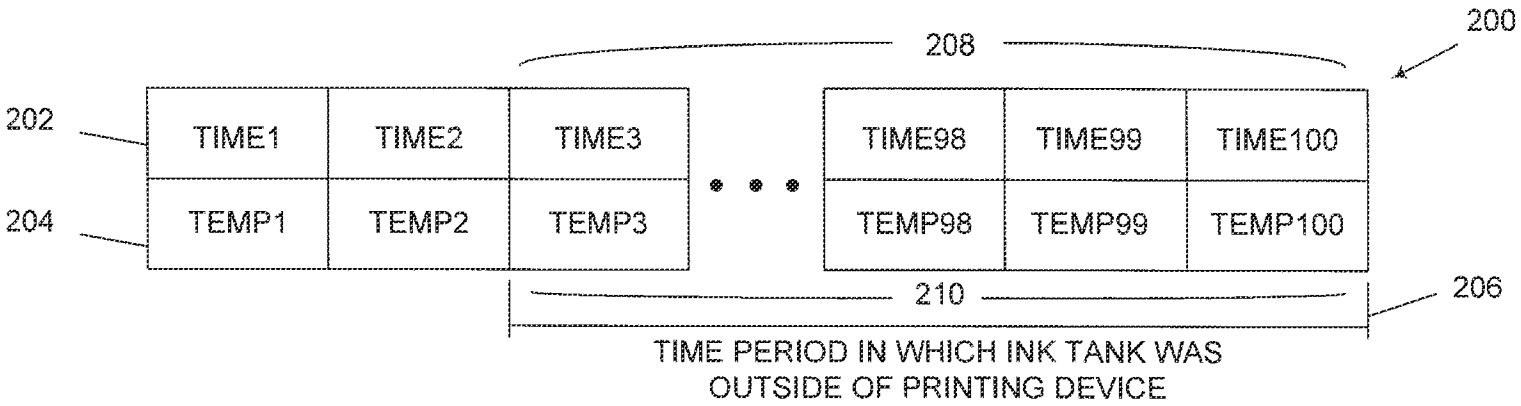

FIG. 2 illustrates an example data structure for storing date information in an example memory of a printing device in accordance with an embodiment of the invention.

FIGS. 3-6 illustrate example methods in accordance with embodiments of the invention.

DETAILED DESCRIPTION OF EMBODIMENTS OF THE INVENTION

Embodiments of the invention now will be described more fully hereinafter with reference to the accompanying drawings. Indeed, these inventions may be embodied in many different forms and should not be construed as limited to the embodiments set forth herein; rather, these embodiments are provided so that this disclosure will satisfy applicable legal requirements. Like numbers refer to like elements throughout.

FIG. 1 illustrates an example system, printing device, and apparatus in accordance with an embodiment of the invention. An example system, such as 100 in FIG. 1, is shown with a printing device 102, and ink tank apparatus or ink tank 104. The system 100 shown can be implemented with various methods in accordance with embodiments of the invention, for instance, the methods 300, 400, 500, and 600 shown respectively in FIGS. 3, 4, 5, and 6.

A printing device 102 can be an ink jet printer or other type of printer. The printing device 102 can include one or more ink tank mounts 106A-N, a cover door 108, a print head 110, and a processor 112. The ink tank mounts 106A-N can each receive a respective ink tank apparatus or ink tank 104. A cover door 108 can be manipulated to provide exterior access to the ink tank mounts 106A-N. Typically, one or more ink tanks 104A-N can be mounted to or within the printing device 102, and when desired, some or all of the ink tanks 104A-N can be removed from the printing device 102. Each of the ink tanks 104A-N can contain a supply of ink, which may be the same or different colors among ink tanks Initially, one or more ink tanks with a full supply of ink can be mounted to the printing device 102. At most any time thereafter, an ink tank 104A-N can be removed and replaced with the same or a different ink tank. When an ink tank, such as 104A is mounted within or to an ink tank mount, such as 106A, the ink tank 104A is typically located in proximity to the print head 110 and provides the print head 110 with a supply of ink. The print head 110 is capable of emitting a marking substance, such as ink, onto a printing medium or surface. A suitable print head is a thermal inkjet print head. In one embodiment, a suitable print head can include print heads that have multiple nozzle arrays such as color print heads.

The processor 112 can control some or all printing operations or processes of the printing device 102. In one embodiment, the processor 112 can include one or more algorithms stored within an associated memory 114 or other data storage device of the printing device 102, which may be executed by the aid of the processor 112 or like computing device to effect various printing operations or processes. Operations such as detecting an opening and closing of the cover door 108 and insertion and/or removal of one or more ink tanks 104A-N from respective ink tank mounts 106A-N can be managed or otherwise facilitated by the processor 112 and/or associated algorithms stored in the memory 114. Collectively, the one or more algorithms and processor and/or other hardware and software for performing some or all of these operations, including but not limited to, determining ink evaporation from at least one ink tank, and determining remaining ink in a plurality of ink tanks associated with a printing device are referred to herein as an ink evaporation estimation module 116. This is done for the sake of simplicity and one of ordinary skill will readily understand that the evaporation estimation module may represent a plurality of distinct modules or components. An example ink evaporation estimation module 116 is shown stored in memory 114. The ink evaporation estimation module may also or alternatively include an application specific integrated circuit (ASIC), firmware, or the like to effect the processes described herein. The ink evaporation estimation module 116 can receive instructions from an associated processor 112 of the printing device 102 and utilize those instructions to determine ink evaporation from at least one ink tank or determine remaining ink in a plurality of ink tanks associated with a printing device. It will be appreciated that the ink evaporation estimation module 116 may comprise one or more distributed components, such as ASICs, processors, memories, firmware, hardware, and the like to effect operation of the processes described herein.

As used herein, the terms "date code" and "date information" can be used interchangeably and can be used to refer to information associated with one or more dates, times, or various measures of a date and/or time.

In one embodiment, the processor 112 can include or otherwise communicate with a clock or real time clock (RTC) 118. In this example, the RTC 118 can determine a date and time even when little or no electrical power is provided to the printing device 102. In some instances, a clock or RTC 118 can include a backup battery such that continuous power can be provided to the clock or RTC 118 when the associated printing device is unplugged from a power source, and thus, the clock or RTC 118 can maintain time. In any instance, the date and time can be transmitted to or otherwise obtained by and/or stored by the processor 112 as a date code or date information in the associated memory 114 of the printing device 102.

In another embodiment, the processor 112 can include or otherwise communicate with other environmental sensors, such as a thermometer 120 and/or humidity gauge 122. In this example, the thermometer 120 and humidity gauge 122 can determine a temperature and relative humidity, which can be determined even when little or no electrical power is provided to the printing device 102. The temperature and relative humidity can be transmitted to or otherwise obtained by the processor 112, and stored by the processor 112 with a date code or date information in the associated memory 114 of the printing device 102. Other environmental measurements and/or estimations can be determined, stored, and utilized in accordance with other embodiments of the invention.

In at least one embodiment, an algorithm operable to determine or otherwise estimate an amount of ink remaining in an ink tank or ink jet cartridge can be implemented by a processor 112 and/or ink evaporation estimation module 116. For example, one algorithm can include a dot counting algorithm or set of instructions operable to count dots. Dot counting can relate to counting of ink droplets which are fired by a print head, such as 110, or associated printing device, such as 102, and correlation of the number of droplets fired with a quantity of ink remaining in the ink tank or ink jet cartridge. Within the dot counting algorithm, a correction factor can account for an amount of ink evaporation which occurs while the ink tank or ink jet cartridge is mounted to or otherwise installed with respect to the print head 110 and/or printing device 102. However, the speed of ink evaporation for an ink tank or ink jet cartridge that is not mounted to or otherwise installed with respect to the print head 110 and/or printing device 102 can be relatively higher than for an ink tank or ink jet cartridge is mounted to or otherwise installed. In these instances, an additional correction factor can account for an amount of ink evaporation which may occur while the ink tank or ink jet cartridge is not mounted to or otherwise installed with respect to the print head 110 and/or printing device 102.

In at least one embodiment, an example algorithm for determining or estimating remaining ink in an ink tank could be as follows: Remaining Ink=Total Initial Ink Volume-Used Ink Amount (# of Ink Droplets Fired)-Correction Factor of Estimated Ink Evaporation. An example algorithm for determining or estimating ink evaporation or the Correction Factor of Estimated Ink Evaporation can be based at least in part on the total time an ink tank was removed from one or more printing devices, the average environmental temperature during the time the ink tank was removed, and the average humidity during the time the ink tank was removed. In other embodiments, other algorithms with similar or different elements, and fewer or greater numbers of elements and/or factors can be implemented with embodiments of the invention.

Referring to the ink tanks 104A-N, each ink tank, such as 104A, can include a memory, such as 124A. Each memory 124A-N can be a data storage device operable to store at least one date code and/or date information. In one embodiment, the memory 124A-N can be operable to transmit at least one date code and/or date information to a printing device 102, processor 112 and/or ink evaporation estimation module 116. When the ink tank 104A is mounted within or to the printing device 102 via at least one ink tank mount 106A, the processor 112 and/or ink evaporation estimation module 116 can communicate with the memory 124A of the ink tank 104A. In one embodiment, the processor 112 and/or ink evaporation estimation module 116 can transmit a date code or date information obtained from the RTC 118 to the memory 124A of the ink tank 104A, which the memory 124A can store for subsequent retrieval or processing. In some instances, temperature and/or relative humidity information can also be transmitted to the memory 124A of the ink tank 104A for storage. In another embodiment, the processor 112 and/or ink evaporation estimation module 116 can receive or otherwise obtain a previously stored data code or date information (and in some instances, including temperature and/or relative humidity information) from the memory 124A of the ink tank 104A, which the processor 112 and/or ink evaporation estimation module 116 can utilize for subsequent processing or storage.

In use, embodiments of the example system 100, printing device 102, and apparatus 104A-N shown in FIG. 1 can be used for determining ink evaporation from at least one ink tank. In addition, embodiments can also be used for determining remaining ink in a plurality of ink tanks associated with a printing device. Thus, in the embodiment of the printing device 102 shown in FIG. 1, each time the cover door 108 is opened and the ink tank and/or print head carrier is moved to an ink tank install position, a date code or date information can be transmitted by a processor 112 and/or ink evaporation estimation module 116 to a memory 124A associated with at least one ink tank 104A mounted to or otherwise installed with respect to the printing device 102. The date code or date information can be obtained by or otherwise received by the processor 112 and/or ink evaporation estimation module 116, which can access or otherwise maintain a clock or RTC 118.

When date code or date information is stored in the ink tank memory 124A or the printer memory 114, the ink tank 104A can be removed from one printing device 102 for any period of time, and the ink tank 104A may be mounted to or otherwise installed in another or second printing device similar to 102. Storing the date code or date information in the ink tank memory 124A and/or printer memory 114 can permit the second printing device to perform a determination or estimation of the remaining ink in the ink tank 104A based at least in part on a determination, estimation and/or correction of estimated ink evaporation.

When the ink tank 104A is installed in the printing device 102 or second printing device, similar to 102, at least a portion of the date code or date information stored in the ink tank memory 124A can be transmitted to or otherwise received by the processor 102 and/or ink evaporation estimation module 116 (or in the instance of the second printing device, a processor and/or ink evaporation estimation module similar to 102 and/or 116). The date code or date information can indicate or otherwise represent the last time the ink tank 104A was removed from a printing device, such as 102. The processor 102 and/or ink evaporation estimation module 116 can use the date code or date information to determine how long the ink tank 104A may have been left outside of a printing device, such as 102, by comparing the date code or date information to current date information obtained from a clock or RTC 118. The differences in date information, or the length of time determined based on the comparison, can be used to adjust the estimation of ink remaining in the ink tank 104A by accounting for an estimated amount of ink lost to evaporation while the ink tank was not installed in a printer.

In one embodiment, date codes or date information associated with multiple removals and installations and/or mountings of a particular ink tank with respect to one or more printing devices can be used by a processor 112 and/or ink evaporation estimation module 116 to determine or otherwise estimate an amount of ink remaining in an ink tank or ink jet cartridge. In this manner, the example system 100, printing device 102, and apparatus or ink tank 104A-N shown in FIG. 1 can handle or otherwise facilitate handling multiple and/or repeat instances of an ink tank 104A-N being left outside a printing device, such as 102.

In one embodiment, after the processor 112 and/or ink evaporation estimation module 116 has determined the time during which a particular ink tank, such as 104A, has been left outside a printing device, such as 102, additional data can be used to determine an amount of ink evaporation which has occurred. For example, a printing device such as 102 may continually collect temperature and/or humidity data from an environment in which the printing device 102 is located. Using temperature data from a thermometer, such as 120, the processor 112 and/or ink evaporation estimation module 116 could average collected temperature data for the time period the ink tank 104A was outside the printing device 102 and use the resulting temperature in a lookup table correlating temperature to ink evaporation rate. Likewise, humidity data from a humidity gauge 122 could average collected humidity data for the same time period, and the resulting humidity could be used to correlate the humidity to an ink evaporation rate. Using either or both methodologies could improve determination and/or estimation of a remaining ink amount in and/or ink evaporation from an ink tank or ink jet cartridge.

In other embodiments, the estimation of evaporation does not necessarily take into account environmental factors such as temperature and humidity. For example, a determination can be made as to how much ink is lost to evaporation when a tank is left open and uninstalled under normal operating conditions (e.g., in a room having a temperature between 68 degrees and 72 degrees Fahrenheit). Such a determination might lead to an estimation that X milliliters of ink is lost to evaporation for every Y hours a tank is left open and uninstalled. Using the processes described herein, the estimation of evaporated ink is determined by multiplying the number of hours the tank is left uninstalled by a predetermined estimate of evaporated ink lost in an hour to arrive at an estimated amount of ink lost during the period that the tank was not installed in a printer. In these embodiments, when the tank is later re-installed in a printer, the estimate of ink remaining in the ink tank is adjusted to account for the estimate of ink lost to evaporation.

FIG. 2 illustrates an example data structure for storing date information in an example memory of a printing device in accordance with an embodiment of the invention. As shown in FIG. 2, a data structure 200 can include a time register 202 and a temperature register 204. The data structure 200 can be stored in, for example, a printing device memory such as 114 in FIG. 1 or an ink tank memory 124A-N in FIG. 1. The time register 202 shown in FIG. 2 can be operable to store a date and a time received from or otherwise obtained from a clock, such as the RTC 118 in FIG. 1. The temperature register 204 can be operable to store a temperature measurement received from or otherwise obtained from a thermometer, such as 120 in FIG. 1. In other embodiments, other registers may exist, and other environmental data, times, or date data or information can be stored in these or other registers.

A flag 206 or other device associated with the data structure 200 can be used to indicate a particular set of data, such as a particular period of time an ink tank was not installed in or otherwise removed from a printing device. For instance, as shown, the flag 206 can indicate a series of times 208 and corresponding temperatures 210 during which a particular ink tank was not installed in or otherwise removed from a printing device. A processor, such as 112 in FIG. 1, and/or an ink evaporation estimation module 116 can utilize some or all of the information in the data structure 200 to determine ink evaporation from at least one ink tank or determine remaining ink in a plurality of ink tanks associated with a printing device. Methods operable to utilize the data structure 200 including some or all of the associated data, or to utilize other data structures in accordance with embodiments of the invention, are described in FIGS. 3-6 below.

Figure 3:
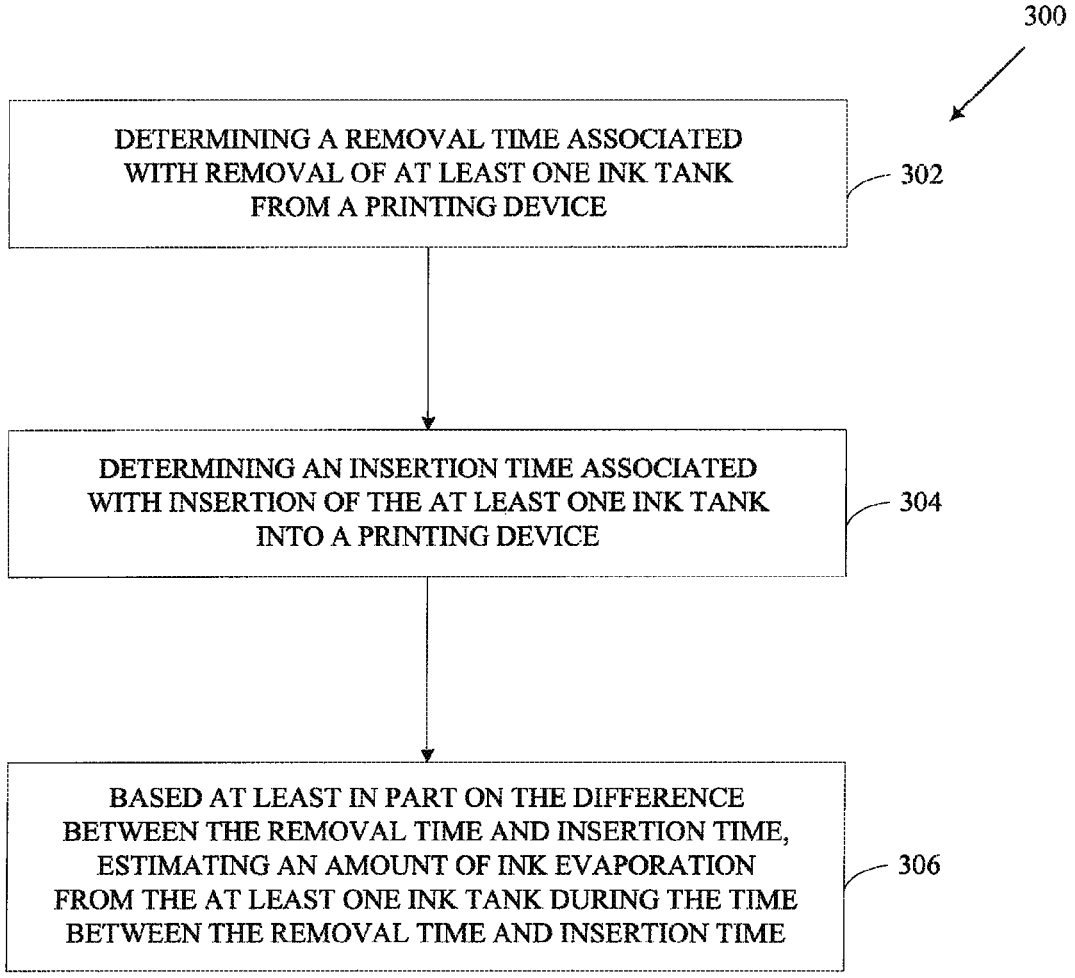

FIGS. 3-6 illustrate example methods in accordance with embodiments of the invention. In FIG. 3, a method 300 for determining ink evaporation from at least one ink tank is shown. The method 300 can be implemented using, for example, the system 100 shown in FIG. 1. Methods according to other embodiments of the invention can include some or all of the elements shown in FIG. 3, and may include fewer or greater elements than the method 300 shown.

The method 300 begins at block 302. In block 302, a removal time associated with removal of at least one ink tank from a printing device is determined. In the embodiment shown, a processor 112 and/or ink evaporation estimation module 116 associated with a printing device 102 can determine a time, such as a date and time, when an ink tank 104A-N is removed from the printing device 102. For example, when an ink tank 104A is removed from an associated ink tank mount 106A, the processor 112 and/or ink evaporation estimation module 116 can obtain a date and time from an associated real time clock (RTC) 118, and store the date and time in a memory 124A associated with the ink tank 104A. In one embodiment, the date and time can be stored in a memory 114 associated with the printing device 102.

Block 302 is followed by block 304, in which an insertion time associated with insertion of the at least one ink tank into a printing device is determined. In the embodiment shown, a processor 112 and/or ink evaporation estimation module 116 associated with a printing device 102 can determine a time, such as a date and time, when an ink tank 104A-N is inserted or otherwise installed in the printing device 102. For example, when an ink tank 104A is inserted or otherwise installed in an associated ink tank mount 106A, the processor 112 and/or ink evaporation estimation module 116 can obtain a date and time from an associated real time clock (RTC) 118, and store the date and time in a memory 114 associated with the printing device 102. In one embodiment, the date and time can be stored in a memory 124A associated with the ink tank 104A.

Block 304 is followed by block 306, in which based at least in part on the difference between the removal time and insertion time, an amount of ink evaporation from the at least one ink tank during the time between the removal time and insertion time is estimated. In the embodiment shown, the processor 112 and/or ink evaporation estimation module 116 can estimate or otherwise determine an amount of ink evaporation from the ink tank 104A based at least in part on the difference between the removal time obtained or otherwise retrieved from the ink tank memory 124A and the insertion time obtained or otherwise retrieved from the printing device memory 114. For example, a time difference can be determined by the processor 112 and/or ink evaporation estimation module 116, and an associated algorithm can be utilized to determine or otherwise estimate an amount of ink evaporation from the ink tank 104A between the removal time and the insertion time.

The method 300 ends after block 306.

In one embodiment, the method 300 can include detecting removal of the at least one ink tank from the printing device.

In one aspect of an embodiment of the method 300, the removal time or the insertion time can include a date and a time.

In one embodiment, the method 300 can include storing the removal time in a memory associated with either the at least one ink tank or the printing device.

In one embodiment, the method 300 can include detecting insertion of the at least one ink tank into a printing device.

In one aspect of an embodiment of the method 300, removal of the at least one ink tank is from a first printing device, and insertion of the at least one ink tank is into a second printing device.

In one aspect of an embodiment of the method 300, estimating an amount of ink evaporation from the at least one ink tank during the time between the removal time and insertion time is further based at least in part on either temperature or humidity data measured outside of the printing device for the time between the removal time and insertion time.

In one embodiment, the method 300 can include determining an amount of ink remaining in the at least one ink tank based at least in part on the amount of ink evaporation.

In one embodiment, the method 300 can include determining a number of ink dot counts remaining in the at least one ink tank based at least in part on the amount of ink evaporation.

Figure 4:
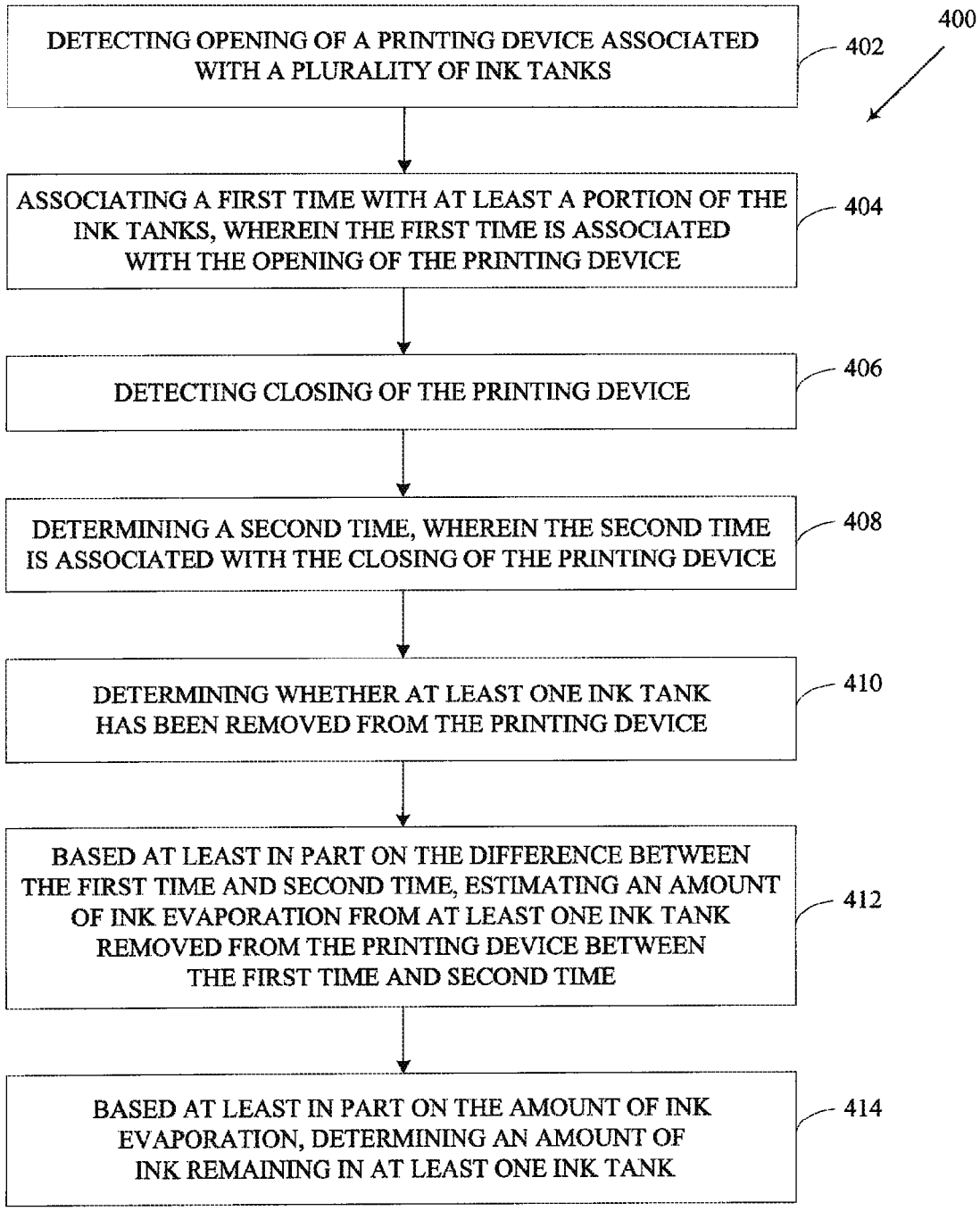

In FIG. 4, a method 400 for determining remaining ink in a plurality of ink tanks associated with a printing device is shown. The method 400 can be implemented using, for example, the system 100 shown in FIG. 1. Methods according to other embodiments of the invention can include some or all of the elements shown in FIG. 4, and may include fewer or greater elements than the method 400 shown.

The method 400 begins in block 402. In block 402, opening of a printing device associated with a plurality of ink tanks is detected. In this embodiment, a processor 112 and/or ink evaporation estimation module 116 associated with a printing device 102 can detect opening of a cover door 108 associated with a printing device 102. For example, a switch, sensor, or other device can be utilized in conjunction with a cover door 108 to communicate a signal to the processor 112 and/or ink evaporation estimation module 116 when the cover door 108 has been moved to a relatively open position with respect to the printing device 102. The cover door 108 of FIG. 1 is shown in a relatively open position. Typically, opening of a cover door or access to some or all of the ink tanks in a printing device can be interpreted as an event associated with removal of some or all of the ink tanks from the printing device.

Block 402 is followed by block 404, in which a first time is associated with at least a portion of the ink tanks, wherein the first time is associated with the opening of the printing device. In the embodiment shown, the processor 112 and/or ink evaporation estimation module 116 can determine a time, such as a date and time, when the printing device 102 is opened, which may be indicative of when an ink tank 104A-N is removed from the printing device 102. For example, when a cover door 108 is moved to a relatively open position, which may be indicative of at least one ink tank 104A being removed from an associated ink tank mount 106A, the processor 112 and/or ink evaporation estimation module 116 can obtain a date and time from an associated RTC 118, and store the date and time in a memory 124A associated with the ink tank 104A. In one embodiment, the date and time can be stored in a memory 114 associated with the printing device 102.

Block 404 is followed by block 406, in which closing of the printing device is detected. In this embodiment, the processor 112 and/or ink evaporation estimation module 116 can detect closing of the cover door 108 associated with a printing device 102. For example, a switch, sensor, or other device can be utilized in conjunction with a cover door 108 to communicate a signal to the processor 112 and/or ink evaporation estimation module 116 when the cover door 108 has been moved to a relatively closed position with respect to the printing device 102. The hidden lines associated with the cover door 108 of FIG. 1 show movement of the door 108 towards a relatively closed position.

Block 406 is followed by block 408, in which a second time is determined, wherein the second time is associated with the closing of the printing device. In the embodiment shown, the processor 112 and/or ink evaporation estimation module 116 can determine a time, such as a date and time, when a cover door 108 is moved to a relatively closed position, which may be indicative of when an ink tank 104A-N has been inserted or otherwise installed in the printing device 102. For example, when an ink tank 104A is inserted or otherwise installed in an associated ink tank mount 106A, the processor 112 and/or ink evaporation estimation module 116 can obtain a date and time from an associated RTC 118, and store the date and time in a memory 114 associated with the printing device 102. In one embodiment, the date and time can be stored in a memory 124A associated with the ink tank 104A.

Block 408 is followed by block 410, in which a determination whether at least one ink tank has been removed from the printing device is made. In this embodiment, the processor 112 and/or ink evaporation estimation module 116 can compare date codes or date information stored in the ink tank memory 124A and the printing device memory 114 to determine if a difference between the date information exists. If a difference exists, a determination can be made that the ink tank 104A has been removed from the printing device 102. If an insubstantial difference exists, a determination may be made that the ink tank 104A has not been removed from the printing device 102.

One of ordinary skill will recognize that several mechanical and electrical methods are known in the art for determining whether an ink tank has been removed from a printer and that any of these can be used effectively with various embodiments of the present invention.

Block 410 is followed by block 412, in which an amount of ink evaporation from at least one ink tank removed from the printing device between the first time and second time is estimated based at least in part on the difference between the first time and second time. In the embodiment shown, the processor 112 and/or ink evaporation estimation module 116 can estimate or otherwise determine an amount of ink evaporation from the ink tank 104A based at least in part on the difference between the first or removal time obtained or otherwise retrieved from the ink tank memory 124A and the second or insertion time obtained or otherwise retrieved from the printing device memory 114. The time difference determined by the processor 112 and/or ink evaporation estimation module 116 can be an input to an associated algorithm which can be utilized to determine or otherwise estimate an amount of ink evaporation from the ink tank 104A between the removal time and the insertion time.

Block 412 is followed by block 414, in which a determination of an amount of ink remaining in the at least one ink tank is made based at least in part on the amount of ink evaporation. In this embodiment, the amount of ink evaporation determined by the processor 112 and/or ink evaporation estimation module 116 can be an input to an associated algorithm which can be utilized to determine or otherwise estimate an amount of ink remaining in the ink tank 104A.

The method 400 ends after block 414.

In one aspect of an embodiment of method 400, associating a first time with at least a portion of the ink tanks can include transmitting a date code from the printing device to at least one ink tank, and storing the date code in a memory associated with the at least one ink tank or the printing device.

In one aspect of an embodiment of method 400, estimating an amount of ink evaporation from at least one ink tank removed from the printing device between the first time and second time is further based at least in part on either temperature or humidity data measured outside of the printing device for the time between the first time and second time.

In one aspect of an embodiment of method 400, the first time or second time can include a time and a date.

In one aspect of an embodiment of method 400, determining an amount of ink remaining in the at least one ink tank can include determining a number of ink dot counts remaining in the at least one ink tank.

Figure 5:
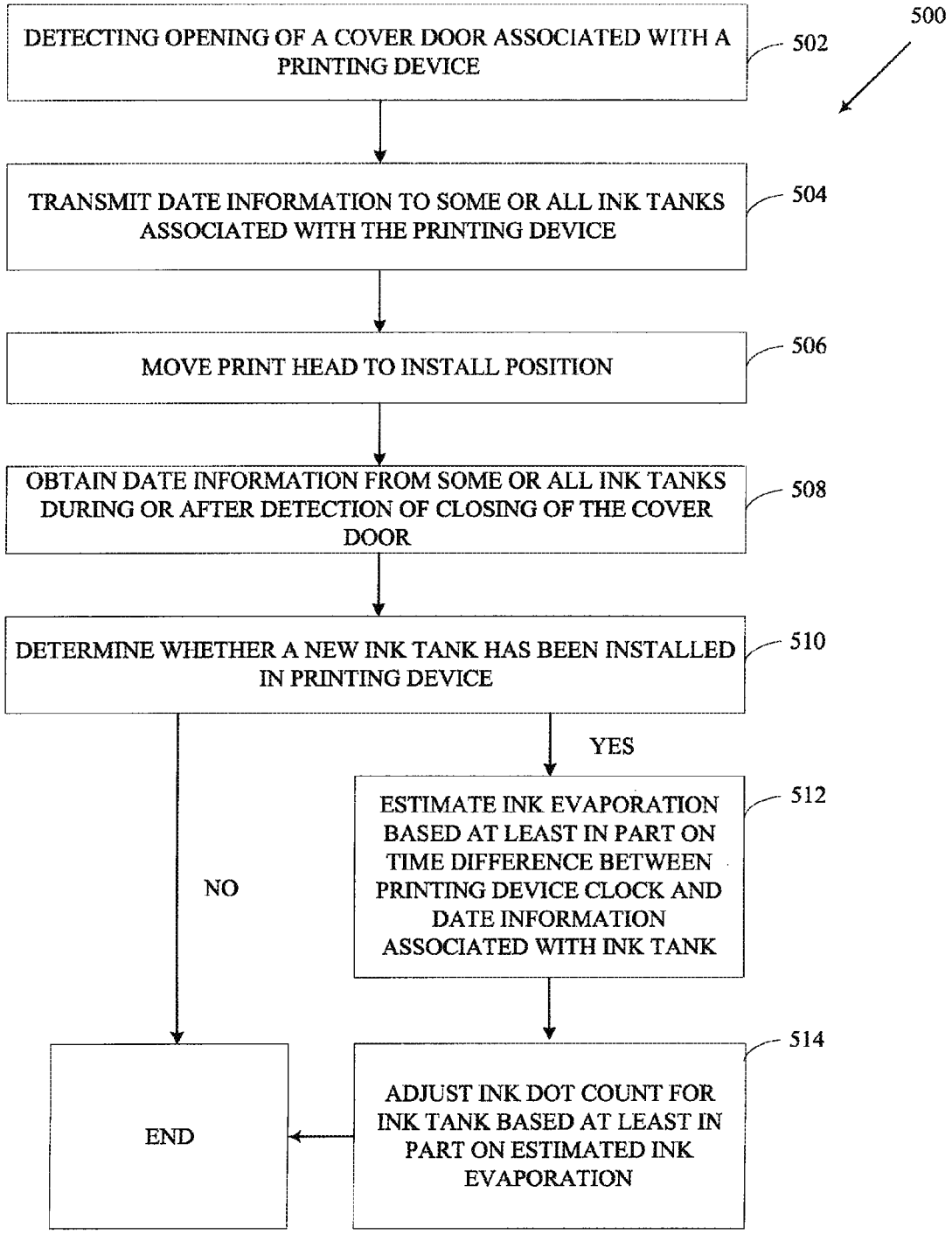

In FIG. 5, a method 500 for determining remaining ink in a plurality of ink tanks associated with a printing device is shown. The method 500 can be implemented using, for example, the system 100 shown in FIG. 1. Methods according to other embodiments of the invention can include some or all of the elements shown in FIG. 5, and may include fewer or greater elements than the method 500 shown.

The method 500 begins in block 502. In block 502, opening of a cover door associated with a printing device is detected. In this embodiment, when the cover door, such as 108 in FIG. 1, is opened, a processor, such as 112, and/or ink evaporation estimation module, such as 116, associated with a printing device, such as 102, can detect the opening of the door 108.

Block 502 is followed by block 504, in which a date code is written to some or all ink tanks associated with the printing device. In this embodiment, the processor 112 and/or ink evaporation estimation module 116 can transmit and write a date code, such as a time and date from a clock or RTC 118 associated with the processor 112, to one or more respective memories, such as 124A-N, of some or all ink tanks 104A-N associated with the printing device 102.

Block 504 is followed by block 506, in which an associated print head is moved to an install position. In this embodiment, a print head, such as 110, can be moved to an ink tank install position. The install position can permit one or more ink tanks 104A-N to be removed from and/or installed or otherwise mounted in the printing device 102.

Block 506 is followed by block 508, in which respective date codes associated with some or all ink tanks are transmitted to the printing device when the cover door is closed. In this embodiment, the processor 112 and/or ink evaporation estimation module 116 can detect the closing of the cover door, such as 108, and date codes or date information associated with some or all of the ink tanks 104A-N installed in the printing device 102 can be obtained or otherwise received by the processor 112 and/or ink evaporation estimation module 116.

Block 508 is followed by block 510, in which a determination is made whether a new ink tank was installed in the printing device. In this embodiment, the processor 112 and/or ink evaporation estimation module 116 can determine whether a new ink tank was installed in the printing device 102 based at least in part on the date codes or date information associated with the ink tanks 104A-N installed in the printing device 102. The processor 112 and/or ink evaporation estimation module 116 can compare date codes or date information stored in the ink tank memory 124A and the printing device memory 114 to determine if a difference between the date information exists. If an insubstantial difference exists, a determination may be made that the ink tank 104A has not been removed from the printing device 102. Thus, if no new ink tank was installed, then the "NO" branch is followed to block 512, in which the method 500 ends.

If a difference exists, a determination can be made that the ink tank 104A has been removed from the printing device 102. Thus, if at least one new ink tank was installed, then the "YES" branch is followed to block 514, in which an estimated ink evaporation is determined based at least in part on the difference between a printing device date and time and the date code or date information associated with the ink tank 104A. In this embodiment, the processor 112 and/or ink evaporation estimation module 116 can utilize the difference between date and time associated with the ink tank 114A and the date and time associated with the printing device 102 to determine an estimated time the ink tank 104A has been removed from a printing device, such as 102 or others. The time difference determined by the processor 112 and/or ink evaporation estimation module 116 can be an input to an associated algorithm which can be utilized to determine or otherwise estimate an amount of ink evaporation from a particular ink tank, such as 104A, between the removal time and the insertion time.

Block 514 is followed by block 516, in which an ink tank level is transmitted to an ink tank memory based at least in part on the estimated ink evaporation. In this embodiment, the amount of ink evaporation determined by the processor 112 and/or ink evaporation estimation module 116 can be an input to an associated algorithm which can be utilized to determine or otherwise estimate an amount of ink remaining in a particular ink tank, such as 104A. The amount of ink or ink tank level can be transmitted to the ink tank memory, such as 124A, or printing device memory 114 for subsequent storage and/or retrieval.

The method 500 ends after block 516.

Figure 6:
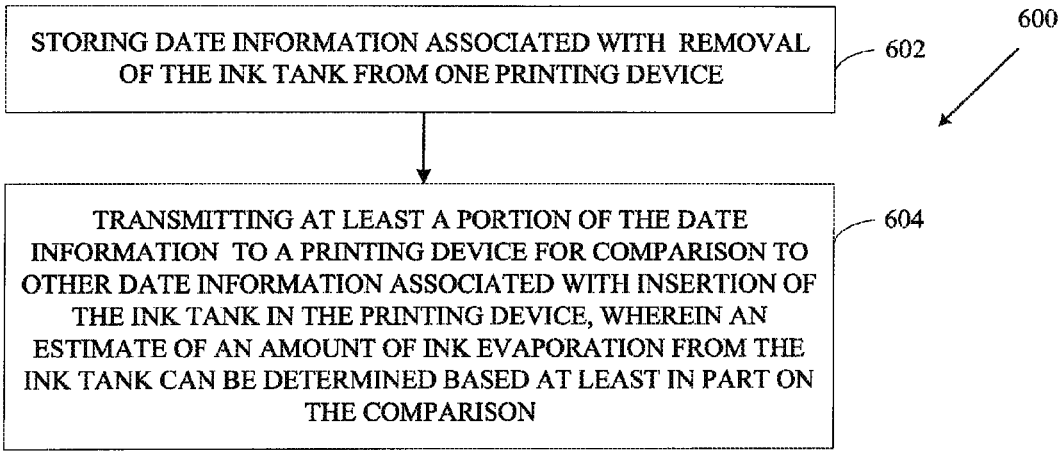

In FIG. 6, a method 600 for determining ink evaporation from an ink tank for a printing device is shown. The method 600 can be implemented using, for example, the ink tank apparatus or ink tank 104 shown in FIG. 1. Methods according to other embodiments of the invention can include some or all of the elements shown in FIG. 6, and may include fewer or greater elements than the method 600 shown.

The method 600 begins in block 602. In block 602, date information associated with removal of the ink tank from one printing device is stored. In this embodiment, date information, such as a date and time, associated with removal of an ink tank 104A from a printing device 102 can be stored in a memory 124A associated with the ink tank 104A. A processor 112 and/or ink evaporation estimation module 116 can determine removal of the ink tank 104A, or otherwise detect opening of a cover door 108 associated with the printing device 102, which may be indicative of removal of the ink tank 104A. In any instance, the processor 112 and/or ink evaporation estimation module 116 can transmit date information obtained from a clock or RTC 118 to the ink tank memory 124A and the memory 124A can store the date information.

Block 602 is followed by block 604, in which at least a portion of the date information is transmitted to a printing device for comparison to other date information associated with insertion of the ink tank in the printing device, wherein an estimate of an amount of ink evaporation from the ink tank can be determined based at least in part on the comparison. In this embodiment, at least a portion of the stored date information in the ink tank memory 124A can be transmitted to a printing device, such as 102 or another printing device, for comparison to other date information associated with insertion of the ink tank 104A in the printing device 102 or another printing device. The processor 112 and/or ink evaporation estimation module 116 can receive the date information from the ink tank memory 124A, and based at least in part on a comparison of the date information with date information associated with insertion of the ink tank 104A an estimate of an amount of ink evaporation from the ink tank can be determined. The comparison can provide a time difference which can be an input to an associated algorithm which can be utilized to determine or otherwise estimate an amount of ink evaporation from the ink tank 104A between the removal time and the insertion time.

The method 600 ends after block 604.

Many modifications and other embodiments of the inventions set forth herein will come to mind to one skilled in the art to which these inventions pertain having the benefit of the teachings presented in the foregoing descriptions and the associated drawings. Therefore, it is to be understood that the inventions are not to be limited to the specific embodiments disclosed and that modifications and other embodiments are intended to be included within the scope of the appended claims. Although specific terms are employed herein, they are used in a generic and descriptive sense only and not for purposes of limitation. The present invention generally relates to systems and methods for ejecting an inkjet printhead from an inkjet printer.

What is claimed is:

1. A method for estimating an amount of remaining ink in each of a plurality of ink tanks installed in a printing device, the method comprising:

detecting an opening of the printing device;

capturing a first data point representative of a first time period when the printing device is opened;

storing the first data point on a plurality of memory devices associated with the respective plurality of ink tanks;

detecting a closing of the printing device; capturing a second data point representative of a second time period when the printing device is closed;

querying the plurality of memory devices to determine whether any of the plurality of ink tanks have been replaced; and calculating an amount of remaining ink in each of the plurality of ink tanks based at least in part on a plurality of responses from the query.

2. The method of claim 1, wherein the calculating further includes estimating an evaporation loss for each of the ink tanks that has been replaced and modifying a prior estimate of remaining ink for each of the replaced tanks to account for the estimated evaporation loss.

3. The method of claim 1, wherein the querying the plurality of memory devices to determine whether any of the plurality of ink tanks have been replaced further includes comparing the first and second data points for each of the plurality of ink tanks and concluding that an ink tank has been replaced if the difference between the first and second data points exceeds a predetermined threshold.

4. The method of claim 1, further including for each ink tank, storing the amount of remaining ink on a dedicated memory associated with said each ink tank.

* * * * *